United States Patent [19]

Bares et al.

[11] 4,343,548

[45] Aug. 10, 1982

[54] CONTROL SYSTEM FOR REGULATING THE CONCENTRATION OF TONER PARTICLES WITHIN A DEVELOPER MIXTURE

[75] Inventors: Jan Bares, Webster; James C. Maher, Sodus, both of N.Y.

[73] Assignee: Xerox Corporation, Stamford, Conn.

[21] Appl. No.: 151,234

[22] Filed: May 19, 1980

[51] Int. Cl.[3] ..... G03G 15/08

[52] U.S. Cl. ..... 355/3 DD; 118/689; 118/653; 222/DIG. 1; 355/14 D

[58] Field of Search ..... 355/3 R, 3 DD, 14 D; 118/646, 688, 689; 222/DIG. 1

[56] References Cited

U.S. PATENT DOCUMENTS

| | | | |
|---|---|---|---|
| 3,527,651 | 9/1970 | Shelffo et al. | 324/62 X |
| 3,821,938 | 7/1974 | Bacon et al. | 118/312 X |
| 3,910,459 | 10/1975 | Bock et al. | 222/56 |
| 3,932,034 | 1/1976 | Takahashi | 355/3 DD |
| 3,999,687 | 12/1976 | Baer et al. | 222/DIG. 1 X |
| 4,064,834 | 12/1977 | Sund | 118/646 |
| 4,242,434 | 12/1980 | Hirakura et al. | 355/3 DD X |

FOREIGN PATENT DOCUMENTS 1398964 6/1975 United Kingdom .

*Primary Examiner*—Fred L. Braun

[57] ABSTRACT

An apparatus which regulates the developability of a conductive developer mixture by controlling the concentration of toner particles therein. The concentration of toner particles in the developer mixture is adjusted in response to the sensed conductivity.

16 Claims, 6 Drawing Figures

ELECTRODE SPACING
0.178 CENTIMETERS
+ 20 V.
− 20 V.
+ 10 V.
− 10 V.
ELECTRODE SPACING
0.318 CENTIMETERS
+ 10 V.
− 10 V.
$10^{-6}$
$10^{-7}$
CURRENT (AMPERES)
1
2
3
4
TONER CONCENTRATION
( PERCENT )

CONTROL SYSTEM FOR REGULATING THE CONCENTRATION OF TONER PARTICLES WITHIN A DEVELOPER MIXTURE

This invention relates generally to an electrophotographic printing machine, and more particularly concerns an apparatus for controlling the concentration of toner particles in a developer mixture.

Generally, the process of electrophotographic printing includes charging of a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix it to the copy sheet in image configuration.

A common type of developer mixture frequently used in electrophotographic printing machines comprises carrier granules having toner particles adhering triboelectrically thereto. This two-component mixture is brought into contact with the photoconductive surface. The toner particles are attracted from the carrier granules to the latent image. During usage, toner particles are depleted from the developer mixture and must be periodically replenished therein. Heretofore, the concentration of toner particles in the developer mixture was controlled within a preselected bandwidth. Otherwise, if the toner particle concentration within the developer mixture was too low, the resultant copy would be too light. Contrariwise, if the toner particle concentration within the developer mixture was too high, the resultant copy would be too dark.

In an electrophotographic printing machine, the overall control objective is to maintain the developability, i.e. the output density of the copy substantially constant relative to the input density of the original document. In order to achieve the foregoing, it is necessary to regulate the developability of the developer mixture within a selected bandwidth. Developability is related to the concentration of toner particles in the developer mixture as well as environmental conditions such as temperature and humidity. The physical parameters of the development system also affect developability, e.g. spacing, electrical bias, mass flow rate, and magnetic field pattern amongst others. In addition, many other factors such as the state of compaction of the developer mixture, the electrical charge on the toner particles and carrier granules as well as the state of attraction of toner particles to the carrier granule surface influence developability. For example, two batches of substantially identical developer mixtures may have the same concentration of toner particles, however, one batch located in a low humidity environment will produce a copy having an image density that is different from another batch located in a high humidity environment.

Various techniques have been developed for controlling the concentration of toner particles within a developer mixture. The following disclosures appear to be relevant:

| |
|---|
| U.S. Pat. No. 3,527,651<br>Patentee: Shelffo et al.<br>Issued: September 8, 1970 |
| U.S. Pat. No. 3,821,938<br>Patentee: Bacon et al.<br>Issued: July 2, 1974 |
| U.S. Pat. No. 3,910,459<br>Patentee: Bock et al.<br>Issued: October 7, 1975 |
| U.S. Pat. No. 4,064,834<br>Patentee: Sund<br>Issued: December 27, 1977 |
| Great Britain Patent Specification 1,398,964<br>Inventors: Trachtenberg et al.<br>Published: June 25, 1975 |

The relevant portions of the foregoing disclosures may be briefly summarized as follows:

Shelffo et al. describes a magnetic brush developer unit in which an electrode is positioned spaced from the developer roller and in contact with the developer material thereon. A control circuit is coupled to the electrode to sense the resistance of the developer material. The control circuit regulates the operation of the toner dispensing assembly in accordance with the sensed resistance.

Bacon et al. discloses a developer station electrically isolated from the remainder of the reproduction apparatus including the photosensitive plate and connected to ground by a lead. As charges are removed from the developer material with removal of the triboelectrically charged toner, an equal charge returns to the developer material through the developer station and the ground lead. The current in the ground lead represents the time rate of charge removal from the developer material. This current is integrated to obtain the total charge removed during development of the latent image recorded on the photosensitive plate. The total charge signal is used to control dispensing of toner particles into the developer mixture.

Bock et al. describes a developer unit connected to ground by way of a high resistance resistor. The carrier charge flows through this resistor to ground. Since the electrical charge transferred by the toner to the photoconductor is proportional to the mass of toner adhering to the photoconductor, the electrical voltage across the resistor is proportional to the mass of toner deposited on the photoconductor. The voltage across the resistor is used to control dispensing of toner into the developer material.

Sund discloses a developer unit in which a cross-mixer is positioned adjacent the uppermost developer roller. The developer mix is carried over the surface of the developer roller onto the cross-mixer. The cross-mixer is electrically isolated from the developer housing. As the developer mix moves across the cross-mixer, a current flow is generated therein. The current is fed through a resistor to ground. The voltage across the resistor and the current flowing therethrough are proportional to the concentration of toner in the developer mix. This voltage is used to control the feeding of toner into the developer mix from a toner hopper.

Trachtenberg et al. describes a developer unit in which an electrical conductor is coupled to a magnetic brush to sense the potential thereof being connected to a load resistor. The potential across the load resistor is amplified and passed through a sampling circuit. The pulsed output of the sampler is then fed to a threshold sensor which transmits a signal when the amplitude of any pulse exceeds a predetermined threshold level. The output of the threshold sensor is then used to activate a toner replenisher which adds toner to the developing unit when activated.

In accordance with the features of the present invention, there is provided an apparatus for regulating the developability of a developer mixture. The apparatus includes means for sensing the conductivity of the developer mixture. Means are provided for adjusting the developability of the developer mixture in response to the sensed conductivity.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by appended claims.

Figure 1:
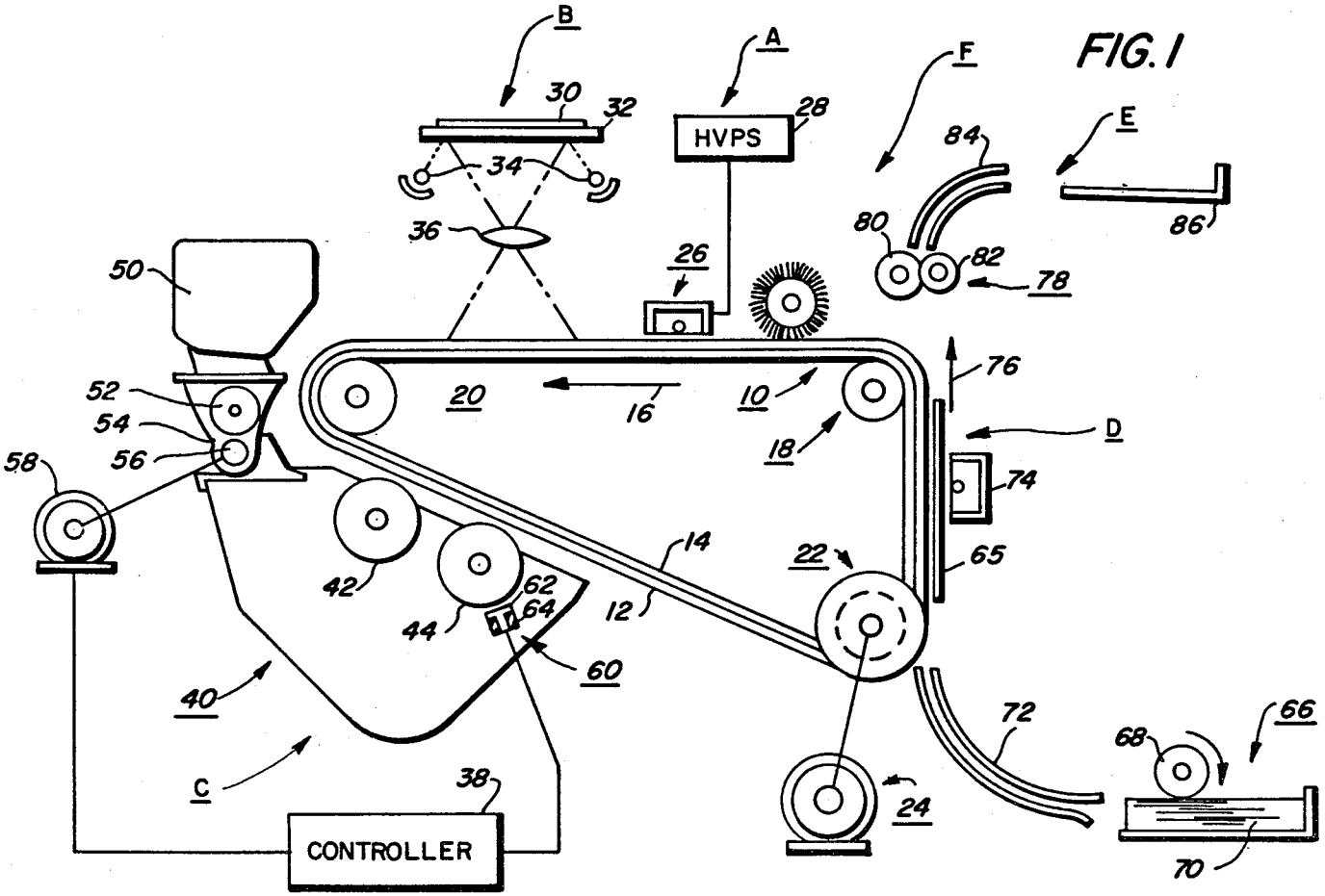
FIG. 1 is a schematic elevational view of an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

The control scheme of the present invention requires that the conductivity of the developer material be detected. The measured conductivity is proportional to the current being transmitted through the developer material. Conductivity of the developer material is a function of the developability of the developer material. Conductivity is highly important in order to insure satisfactory development of the latent image to provide high fidelity copies. By measuring the current being transmitted through the developer material and controlling the concentration of toner particles in the developer material as a function thereof, developability, and, in turn, copy quality may be optimized.

Referring now to FIG. 1, the electrophotographic printing machine employs a belt 10 having a photoconductive surface 12 deposited on a conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized mylar substrate 14 which is electrically grounded. Belt 10 moves in the direction of arrow 16 to advance successive portions of photoconductive surface 12 sequentially through the various processing stations disposed along the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to apply a charge on photoconductive surface 12 of belt 10.

After photoconductive surface 12 of belt 10 is charged, the charge portion thereof is advanced through exposure station B. At exposure station B, an original document 30 is positioned face-down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated generally by the reference numeral 40, advances developer material into contact with the latent image. Preferably, magnetic brush development system 40 includes two magnetic brush developer rollers 42 and 44. Each roller advances developer material into contact with the latent image. These developer rollers form a brush extending outwardly therefrom of carrier granules and toner particles. The latent image attracts toner particles from the carrier granules forming a toner powder image on the latent image. Preferably, the developer material is electrically conductive. As successive electrostatic latent images are developed, toner particles are depleted from the developer material. A toner particle dispenser, indicated generally by the reference numeral 46, is arranged to furnish additional toner particles to developer housing 48 for subsequent use by the developer rollers. Toner dispenser 46 includes a container 50 storing a supply of toner particles therein. Foam roller 52, disposed in a sump 54 beneath container 50, meters toner particles into auger 56. Auger 56 comprises a helical spring mounted in a flexible tube having a plurality of apertures therein. Motor 58 is coupled to the helical member of auger 56. As motor 58 rotates the helical member of auger 56, toner particles advance in the tube so as to be dispensed through the apertures thereof into developer housing 48. Energization of motor 58 is regulated by controller 38. A probe, indicated generally by the reference numeral 60, is positioned closely adjacent to developer roller 44. Probe 60 comprises an electrode 62 located in a non-electrically conductive housing 64. Preferably housing 64 is made from an insulating material, such as plastic. Probe 60 is electrically connected to controller 38 which, in turn, is electrically connected to motor 58. Probe 60 senses the electrical current flowing through the developer material and transmits a signal to controller 38. Controller 38 develops an error signal which actuates motor 58 to dispense toner particles into developer housing 48. Thus, when the electrical current detected by probe 60 is beneath a predetermined level, controller 38 actuates motor 58 to dispense additional toner particles into the developer material. The dispensing of additional toner particles within the developer material changes the toner particle concentration therein, and adjusts the conductivity of the developer material to the desired level. The detailed structure of the controller will be described hereinafter with reference to FIGS. 2 and 3.

By way of example, a suitable two-component developer material comprises magnetic, electrically conductive carrier granules having toner particles adhering thereto triboelectrically. The carrier granules include a ferromagnetic core having a thin layer of magnetite overcoated with a layer of resinous material. Suitable resins include poly(vinylidene fluoride) and poly(vinylidene fluoride-co-tetrafluoroethylene). The developer composition can be prepared by mixing the carrier granules with toner particles. Suitable toner particles are prepared by finely grinding a resinous material and mixing it with a coloring material. The resinous material may be a vinyl polymer such as polyvinyl chloride, polyvinylidene chloride, polyvinyl acetate, polyvinyl acetals, polyvinyl ether, and polyacrylic. Suitable coloring materials maybe, amongst others, chromogen black and solvent black. The developer material comprises about 95% to about 99% by weight of carrier and from about 5% to about 1% by weight of toner, respectively. These and other materials are disclosed in U.S. Pat. No. 4,076,857 issued to Kasper et al. in 1978, the relevant portions thereof being hereby incorporated into the present application.

After the electrostatic latent image is developed, belt 10 advances the toner powder image to transfer station D. A sheet of support material 65 is moved into contact with the toner powder image at transfer station D. The sheet of support material 65 is advanced to transfer station D by sheet feeding apparatus 66. Preferably, sheet feeding apparatus 66 includes a feed roll 68 contacting the uppermost sheet of stack 70. Feed rolls 68 rotates to advance the uppermost sheet from stack 70 into chute 72. Chute 72 directs the advancing sheet of support material into contact with photoconductive surface 12 of belt 10 in a timed sequence so that the toner powder image developed thereon contacts the advancing sheet of support material at transfer station D. Transfer station D includes a corona generating device 74 which sprays ions onto the backside of sheet 64. This attracts the toner powder image from photoconductive surface 12 to sheet 65. After transfer, sheet 65 continues to move, in the direction of arrow 76, onto a conveyor (not shown) which advances sheet 65 to fusing station D.

Fusing station E includes a fuser assembly, indicated generally by the reference numeral 78, which permanently affixes the transferred powder image to sheet 65. Preferably, fuser assembly 78 comprises a heated fuser roller 80 and back-up roller 82. Sheet 65 passes between fuser roller 80 and back-up roller 82 with the toner powder image contacting fuser roller 80. In this manner, the toner powder image is permanently affixed to sheet 65. After fusing, chute 84 advances sheet 65 to catch tray 86 for subsequent removal from the printing machine by the operator.

After the sheet of support material is separated from photoconductive surface 12 of belt 10, the residual toner particles adhering to photoconductive surface 12 are removed therefrom. These particles are removed from photoconductive surface 12 at cleaning station F. Cleaning station F includes a rotatably mounted fibrous brush 88 in contact with photoconductive surface 12. The particles are cleaned from photoconductive surface 12 by the rotation of brush 88 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
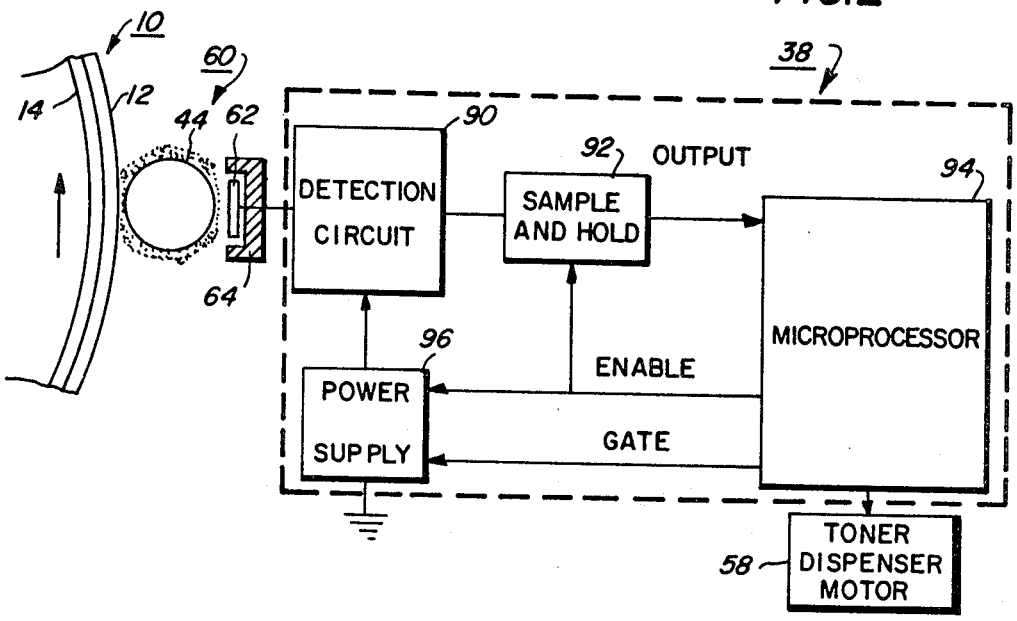
FIG. 2 is a block diagram of a control system used in the FIG. 1 printing machine for regulating the developability of the developer mixture.
Figure 3:
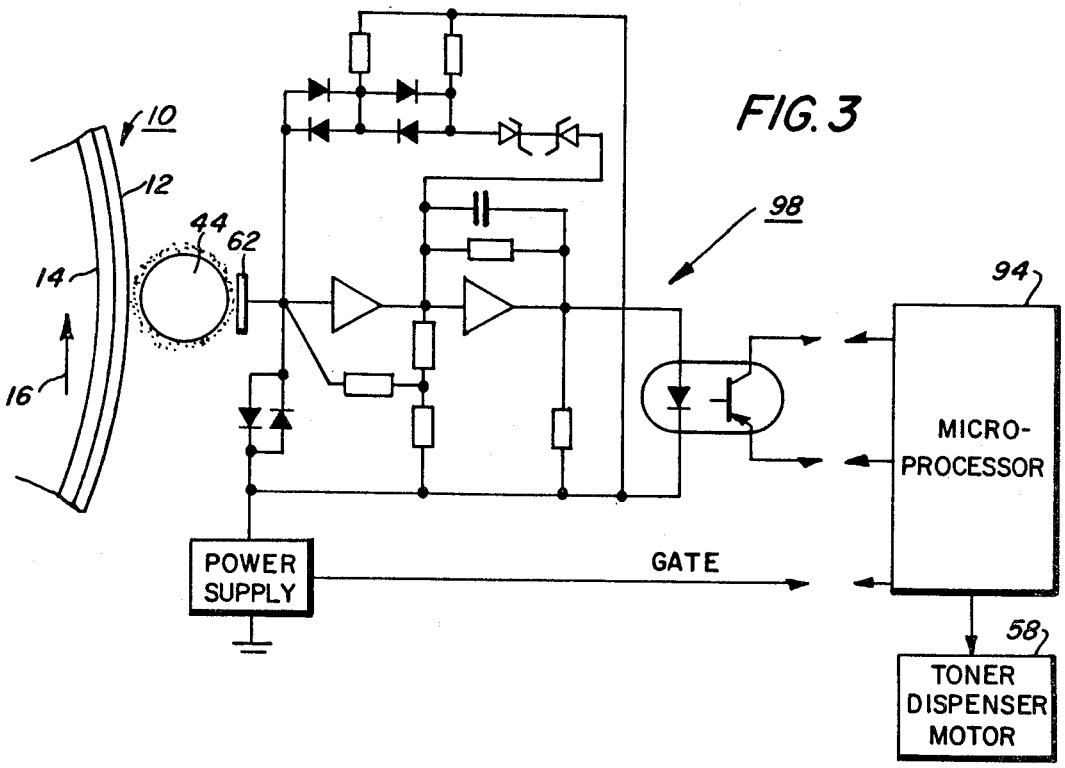
FIG. 3 is a circuit diagram of a portion of the FIG. 2 block diagram.

As illustrated in FIG. 2, electrode 62 of probe 60 is electrically connected to controller 38. Controller 38 includes detection circuit 90 which consists of a current amplifier with some integration, i.e. a capacitor in the feedback loop to reduce noise, and a second stage amplifier. Detection circuit 90 provides filtering and electrical isolation. The electrical output signal from detection circuit 90 is fed to a sample and hold circuit 92 which periodically transmits a signal to microprocessor 94. Microprocessor 94 has a suitable algorithm for comparing the electrical output signal with a desired reference signal to generate an error signal for energizing toner dispenser motor 58. In addition, microprocessor 94 generates an enable and gating signal. The enable signal periodically actuates sample and hold circuit 92 and power supply 96. The gating signal is fed to power supply 96. Power supply 96 provides the necessary electrical bias between developer roller 44 and electrode 62. Preferably, power supply 96 is activated by the enable signal only when developer roller 44 is rotating. If developer roller 44 is electrically grounded, the amplifier of detection circuit 90 is floating on the bias level of power supply 96 with the output being coupled to an optoisolator. The foregoing arrangement is shown in FIG. 3. The polarity of the voltage output of the power supply applied to electrode 62 is periodically switched by action of the gating signal. In this way, two different current measurements are obtained for voltages of the same amplitude and opposite polarities. The difference in the current measurements is then compared to a reference so that microprocessor 94 may generate the error signal. Alternatively, a pair of electrodes can be employed with each electrode being biased to the same amplitude and opposite polarities.

In operation, electrode 62 of probe 60 is in contact with the developer material being transported by developer roller 44. The voltage difference between developer roller 44 and probe 60 induces a flow of electrical current through probe 60. The electrical current is detected by controller 38 which, in turn, produces an error signal. The error signal actuates toner dispenser motor 58 to discharge toner particles into developer housing 48. In this way, the developability of the developer material is maintained at the desired level. This insures that the toner powder image formed on photoconductive surface 12 has the proper density.

Referring now to FIG. 3, there is shown a detailed circuit diagram coupling electrode 62 to microprocessor 94. As shown in FIG. 3, circuit 98 incorporates the elements of detection circuit 90 and sample and hold circuit 92. Circuit 98 includes a current amplifier with a capacitor in the feedback loop to provide integration to reduce noise. A second stage amplifier is provided. When developer roller 44 is electrically grounded, the amplifier ground is floating on the power supply electrical bias with the output signal being coupled through an optoisolator to microprocessor 94. Power supply 96 is activated only when developer roller 44 is running. A gate, either an integral part of the power supply or an added solid state relay, controls power supply 96. An enable signal is fed from the microprocessor or may be fed directly from the drive motor line. Current transients due to switching of power supply 96 are eliminated either by the utilization of a slow power supply voltage rise time, using a resistor and capacitor filter, or directly by filtering in circuit 98. Microprocessor 94 processes the electrical output signal and compares it to a reference signal to develop an error signal. The electrical output signal that is compared to the reference signal in microprocessor 94 is the current difference. This is obtained by switching the electrical bias on probe 60 to opposite polarities with the same amplitude. The difference in detected current is a linear function of toner particle concentration within the developer material. The foregoing is shown more clearly with reference to the graphs of FIGS. 4 through 6, inclusive.

Figure 4:
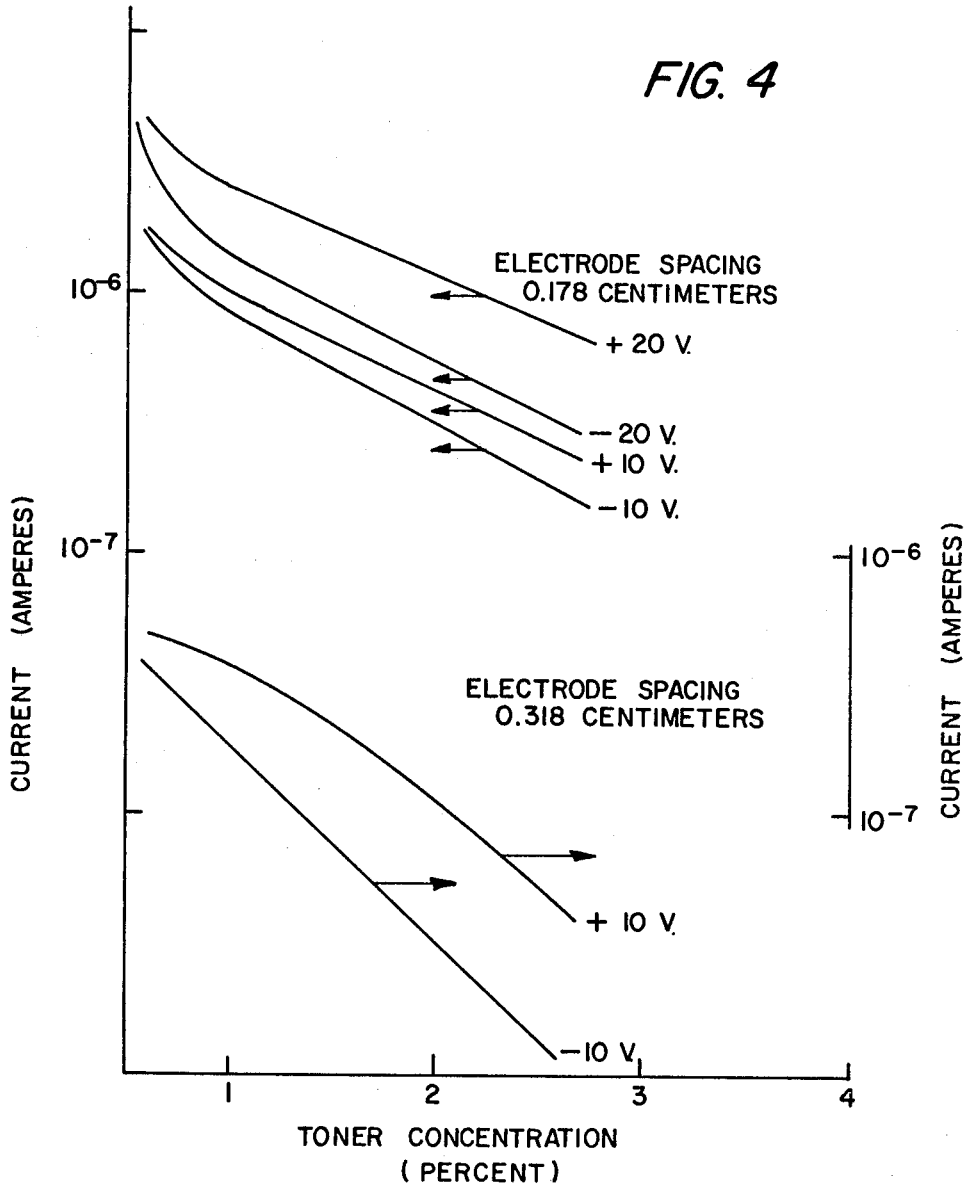
FIG. 4 is a graph showing toner particle concentration as a function of detected current.

Referring now to FIG. 4, the graph thereat depicts, on a semi-log scale toner particle concentration as a function of detected current. As shown thereat, the magnitude of the detected current is a function of the spacing between electrode 62 and developer roller 42 as well as the level of electrical bias and toner particle concentration. When the electrode spacing and voltage is maintained constant, the detected current varies directly as a function of toner particle concentration. FIG. 4 shows the detected current for ±10 volts and ±20 volts and an electrode spacing of 0.178 centimeters. In addition, FIG. 4 depicts the detected current for ±10 volts with an electrode spacing of 0.318 centimeters.

Figure 5:
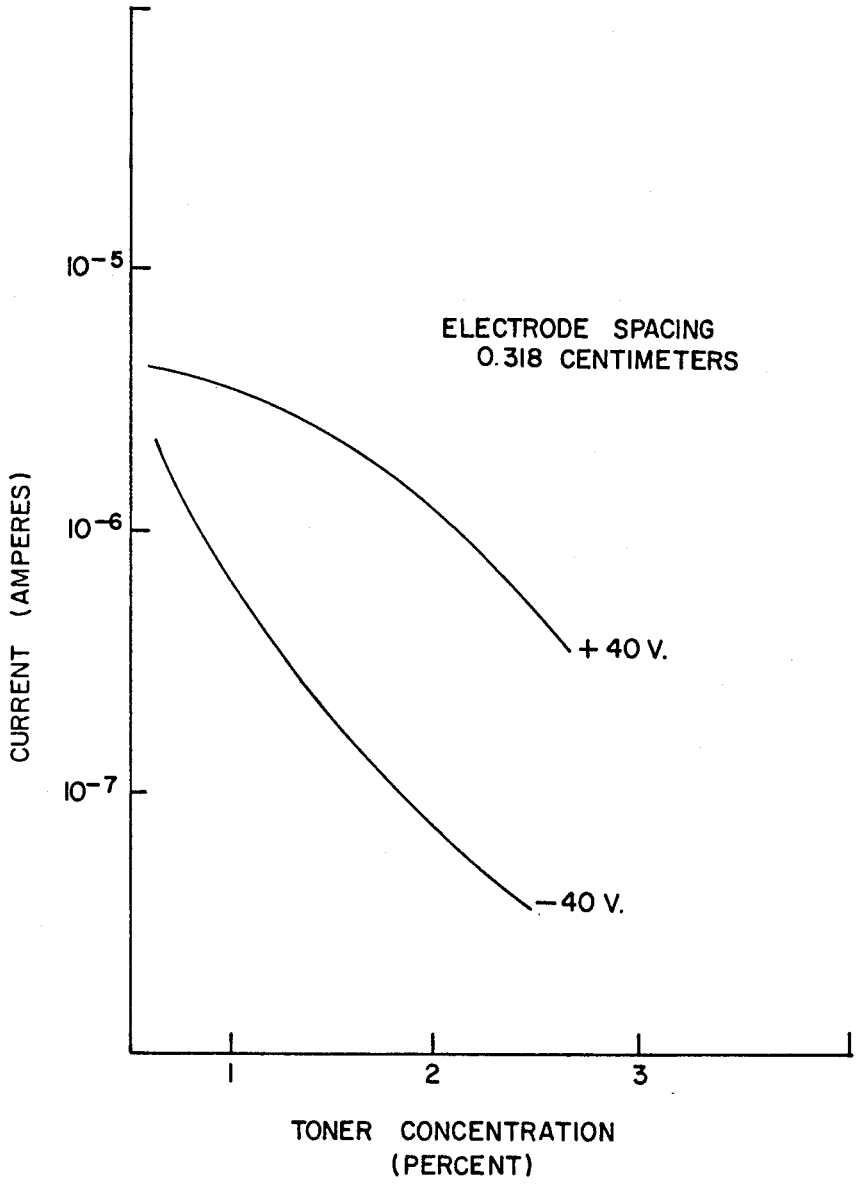
FIG. 5 is another graph illustrating toner particle concentration as a function of detected currents.

Turning now to FIG. 5, there is shown a graph of detected current versus toner particle concentration plotted on a semi-logarithm scale. As shown thereat, electrode 62 is spaced about 0.318 centimeters from developer roller 44. The voltage difference between developer roller 44 and electrode 62 varies from +40 volts to −40 volts.

Figure 6:
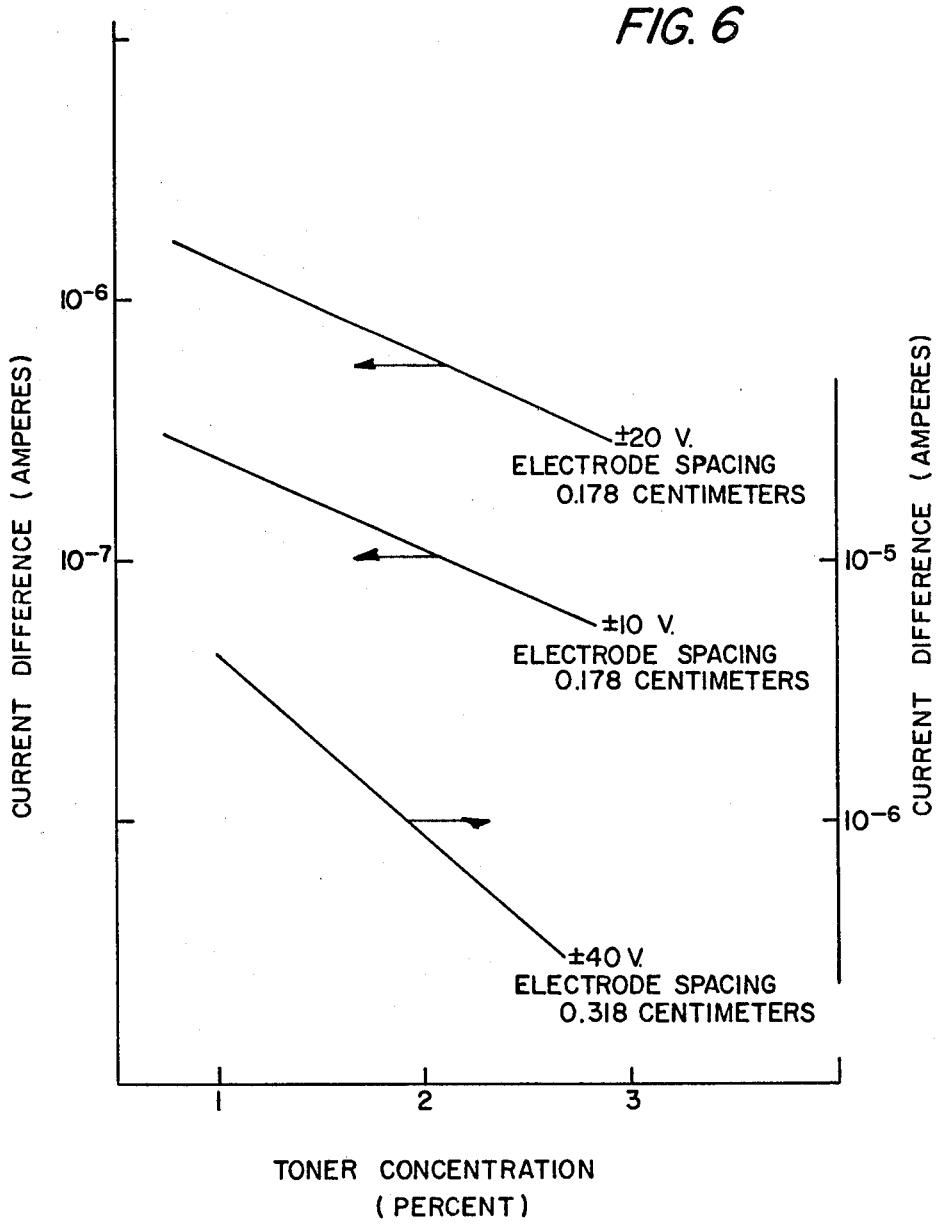
FIG. 6 is a graph depicting toner particle concentration as a function of the detected current difference.

Turning now to FIG. 6, there is shown a graph of the current difference versus toner particle concentration plotted on a semi-logarithm scale for ±10 volts at an electrode spacing of 0.178 centimeters and ±20 volts at an electrode spacing of 0.178 centimeters. In addition, there is shown the current difference for ±40 volt at an electrode spacing of 0.318 centimeters. In all of the foregoing cases, it is seen that the difference in current varies linearly with the toner particle concentration. Hence, the detected current difference provides an excellent measure of the toner particle concentration within the developer mixture. This detected current difference may be compared to a desired reference so as to generate an error signal for energizing the toner dispenser to regulate the toner particle concentration within the developer mixture to the desired level.

Preferably, magnetic brush developer roller 44 comprises a non-magnetic tubular member having a magnet disposed interiorly thereof and spaced therefrom. The tubular member rotates so as to transport the developer material into contact with the latent image recorded on photoconductive surface 12 of belt 10 and probe 60.

In recapitulation, it is apparent that the detected current difference is a monotonic function of the toner particle image developed on the probe. The developability of the developer material is a direct function of the toner particle concentration therein. Hence, by measuring the current difference, toner particle concentration can be regulated to the desired level so as to optimize development of the latent image recorded on the photoconductive surface.

It is, therefore, apparent that there has been provided, in accordance with the present invention, an apparatus for controlling the developability of the developer mixture used in an electrophotographic printing machine. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for regulating the developability of a conductive developer mixture having toner particles therein with the developer mixture being transported on a developer roller, including:

a probe disposed closely adjacent to the developer roller and in contact with the developer mixture;

means for producing a voltage difference between said probe and the developer roller including means for switching the polarity of the voltage difference between said probe and the developer roller;

means for detecting a first and second current flowing through said probe corresponding to the respective polarities of the voltage difference;

means, responsive to the detected current, for generating a control signal corresponding to the difference between the detected first current and the second detected current;

means for storing a supply of toner particles; and means, responsive to the control signal, for dispensing toner particles from said storing means into the developer mixture to adjust the toner particle concentration thereof.

2. An apparatus according to claim 1, wherein said producing means applies an electrical potential to said probe with the developer roller being electrically grounded.

3. An apparatus according to claim 1, wherein said producing means applies an electrical potential to the developer roller.

4. An electrophotographic printing machine of the type having a developer roller for transporting a conductive developer mixture comprising toner particles into contact with an electrostatic latent image recorded on a photoconductive surface so as to develop the latent image with the toner particles, wherein the improvement includes:

a probe disposed closely adjacent to the developer roller and in contact with the developer mixture;

means for producing a voltage difference between said probe and the developer roller including means for switching the polarity of the voltage difference between said probe and the developer roller;

means for detecting first and second currents flowing through said probe corresponding to the respective polarities of the voltage difference;

means, responsive to the detected current, for generating a control signal corresponding to the difference between the detected first current and detected second current;

means for storing a supply of toner particles; and means, responsive to the control signal, for dispensing toner particles from said storing means into the developer mixture to adjust the toner particle concentration thereof.

5. A printing machine according to claim 4, wherein said producing means applies an electrical potential to said probe with the developer roller being electrically grounded.

6. A printing machine according to claim 4, wherein said producing means applies an electrical potential to the developer roller.

7. An apparatus for regulating the developability of a conductive developer mixture having toner particles therein with the developer mixture being transported on a developer roller, including:

a probe disposed closely adjacent to the developer roller and in contact with the developer mixture;

means for producing a voltage difference between said probe and the developer roller;

means for detecting the current flowing through said probe having means for generating a current signal corresponding to said current and means for integrating said current signal to average the noise contribution to said current signal;

means for generating a control signal from said integrated current signal;

means for storing a supply of toner particles; and means, responsive to the control signal, for dispensing toner particles from said storing means into the developer mixture to adjust the toner particle concentration thereof.

8. An electrophotographic printing machine of the type having a developer roller for transporting a conductive developer mixture comprising toner particles into contact with an electrostatic latent image recorded on a photoconductive surface so as to develop the latent image with the toner particles, wherein the improvement includes:

a probe disposed closely adjacent to the developer roller and in contact with the developer mixture;

means for producing a voltage difference between said probe and the developer roller;

means for detecting the current flowing through said probe having means for generating a current signal corresponding to said current and means for integrating said current signal to average the noise contribution to said current;

means for generating a control signal from said integrated current signal;

means for storing a supply of toner particles; and means, responsive to the control signal, for dispensing toner particles from said storing means into the developer mixture to adjust the toner particle concentration thereof.

9. A method of regulating the developability of a conductive developer mixture having toner particles therein, including the steps of:

transporting the developer mixture on a developer roller;

producing a voltage difference between the developer roller and a probe disposed closely adjacent to the developer roller and in contact with the developer mixture thereon by switching the polarity of the voltage difference between the probe and the developer roller so that a first current and a second current flow through the probe corresponding to the respective polarities of the voltage difference;

detecting the first and second current flowing through the probe;

generating a control signal as a function of the difference between the detected first current and detected second current;

storing a supply of toner particles in a container; and dispensing toner particles from the container into the developer mixture to adjust the toner particle concentration thereof in response to the control signal.

10. A method according to claim 9, wherein said step of producing includes the step of applying an electrical potential to the probe with the developer roller being electrically grounded.

11. A method according to claim 9, wherein said step of producing includes applying an electrical potential to the developer roller.

12. A method of electrophotographic printing of the type in which a developer roller transports a conductive developer mixture comprising toner particles into contact with an electrostatic latent image recorded on a photoconductive surface so as to develop the latent image with toner particles, wherein the improvement includes the steps of:

producing a voltage difference between the developer roller and a probe disposed closely adjacent to the developer roller and in contact with the developer mixture thereon by switching the polarity of the voltage difference between the probe and the developer roller so that a first current and a second current flow through the probe corresponding to the respective polarities of the voltage difference;

detecting the first and second current flowing through the probe;

generating a control signal as a function of the difference between the detected first current and detected second current;

storing a supply of toner particles in a container; and dispensing toner particles from the container into the developer mixture to adjust the toner particle concentration therein in response to the control signal.

13. A method of printing according to claim 12, wherein said step of producing includes the step of applying an electrical potential to the probe with the developer roller being electrically grounded.

14. A method of printing according to claim 12, wherein said step of producing includes the step of applying an electrical potential on the developer roller.

15. A method for regulating the developability of a conductive developer mixture having toner particles therein, including the steps of:

transporting the developer mixture on a developer roller;

producing a voltage difference between the developer roller and a probe disposed closely adjacent to the developer roller and in contact with the developer mixture thereon;

detecting the current flowing through the probe;

generating a current signal corresponding to an average current flowing in said probe by integrating the current flowing through the probe;

generating a control signal in response to the current signal;

storing a supply of toner particles in a container; and dispensing toner particles from the container into the developer mixture to adjust the toner particle concentration thereof in response to the control signal.

16. A method of electrophotographic printing of the type in which a developer roller transports a conductive developer mixture comprising toner particles into contact with an electrostatic latent image recorded on a photoconductive surface so as to develop the latent image with toner particles, wherein the improvement includes the steps of:

producing a voltage difference between the developer roller and a probe disposed closely adjacent to the developer roller and in contact with the developer mixture thereon;

detecting the current flowing through the probe;

generating a current signal corresponding to an average current flowing in said probe by integrating the current flowing through the probe;

generating a control signal in response to the current signal;

storing a supply of toner particles in a container; and dispensing toner particles from the container into the developer mixture to adjust the toner particle concentration therein in response to the control signal.

* * * * *